US008845957B2

(12) United States Patent
Guempel et al.

(10) Patent No.: US 8,845,957 B2
(45) Date of Patent: Sep. 30, 2014

(54) METHOD FOR PRODUCING A MAGNETIZABLE METAL SHAPED BODY

(75) Inventors: Paul Guempel, Bodman-Ludwigshafen (DE); Stefan Glaeser, Bottighofen (CH); Beat Hofer, Derendingen (CH)

(73) Assignees: ETO Magnetic GmbH, Stockach (DE); Kennametal Europe GmbH, Neuhausen am Rheinfall (CH)

( * ) Notice: Subject to any disclaimer, the term of this patent is extended or adjusted under 35 U.S.C. 154(b) by 829 days.

(21) Appl. No.: 12/991,552

(22) PCT Filed: Apr. 27, 2009

(86) PCT No.: PCT/EP2009/003041

§ 371 (c)(1), (2), (4) Date: Nov. 8, 2010

(87) PCT Pub. No.: WO2009/135604

PCT Pub. Date: Nov. 12, 2009

(65) Prior Publication Data

US 2011/0058976 A1 Mar. 10, 2011

(30) Foreign Application Priority Data

May 9, 2008 (DE) ..... 10 2008 023 059

(51) Int. Cl.

| | |
|---|---|
| ***B22F 3/15*** | (2006.01) |
| ***H01F 1/24*** | (2006.01) |
| ***H01F 1/22*** | (2006.01) |
| ***H01F 41/02*** | (2006.01) |

(52) U.S. Cl.

CPC ..... *H01F 41/0246* (2013.01); *H01F 1/24* (2013.01); *B22F 2998/10* (2013.01); *H01F 1/22* (2013.01)

USPC ..... 419/31; 419/35; 419/28; 419/44; 419/49; 148/100; 148/306; 252/62.55

(58) Field of Classification Search

USPC ..... 148/100, 104, 121, 513; 419/64, 66, 68, 419/69; 252/62.55, 62.56, 31, 35, 49, 41, 252/43

See application file for complete search history.

(56) References Cited

U.S. PATENT DOCUMENTS

| | | | | |
|---|---|---|---|---|
| 5,116,437 | A * | 5/1992 | Yamamoto et al. | 148/287 |
| 5,352,522 | A * | 10/1994 | Kugimiya et al. | 428/403 |
| 5,993,729 | A | 11/1999 | Lefebvre et al. | |
| 6,544,352 | B2 * | 4/2003 | Mitani et al. | 148/104 |

FOREIGN PATENT DOCUMENTS

WO 02/089154 A 11/2002

* cited by examiner

*Primary Examiner* — George Wyszomierski
*Assistant Examiner* — Ngoclan T Mai
(74) *Attorney, Agent, or Firm* — Bachman & LaPointe, P.C.

(57) ABSTRACT

A method for producing a magnetizable metal shaped body comprising a ferromagnetic starting material that is present in powder and in particulate form, using the following steps: (a) first compaction of the starting material (S3) such that adjoining particles become bonded to each other by means of positive adhesion and/or integral bonding in sections along the peripheral surfaces thereof and while forming hollow spaces, (b) creating an electrically isolating surface coating on the peripheral surfaces of the particles in regions outside the joining sections (S4), and (c) second compaction of the particles (S5) provided with the surface coating, such that the hollow spaces are reduced in size or eliminated.

22 Claims, 2 Drawing Sheets

METHOD FOR PRODUCING A MAGNETIZABLE METAL SHAPED BODY

BACKGROUND OF THE INVENTION

The present invention relates to a method for producing a magnetizable metallic shaped body, to a shaped body produced by a method such as this, and to uses of such a shaped body.

Numerous magnetizable metallic bodies are known from the prior art for producing widely differing electromagnetic apparatuses, for example electromagnetic actuators, transformers or the like. These applications all have the common feature that a material which is used to produce the magnetizable components and assemblies on the one hand is intended to have good magnetic characteristics in the form of as high a (saturation) flux density as possible with low excitation and a low coercivity field strength, in which case pure iron (or materials composed of iron or of iron-silicon alloys) are particularly advantageous in respect of such magnetic characteristics.

On the other hand, particularly in the case of magnets which are operated with alternating currents (in which case the materials have their magnetization reversed in time with the alternating-current frequency), losses occur in particular in the form of eddy current losses; these are the result of voltages induced by the magnetic alternating field, producing eddy currents at right angles to the magnetic alternating field and weakening the magnetic field (also associated with an energy loss). In order to reduce such eddy current losses, it is in turn known for the magnetizable material to be influenced to increase its resistance, for example in the form of laminates in the case of transformers or by the formation of mixed crystals (for example FeNi) in magnetic material. Such an increase in the electrical resistance (resistivity) reduces the described eddy current losses but, at the same time, decreases the magnetic saturation flux density and furthermore adversely affects mechanical characteristics, such as the strength.

However, the negative effects of eddy currents are also not entirely irrelevant in the case of direct-current applications; for example, the magnetization process associated with a switching process leads to eddy currents opposing the process magnetically and limiting the dynamics and movement speed which can be achieved by actuators or the like for magnet applications using direct current.

Furthermore, eddy current losses are highly frequency-dependent, as a result of which, particularly in the case of radio-frequency applications, it is also known, for example, for powder composite materials composed of a metal powder to be used to increase the electrical resistivity, which composite materials are compressed, for example with a polymer binding agent. In addition to the relatively high electrical resistance, for example relative to a laminate, a procedure such as this furthermore has the advantage that eddy currents can be suppressed three-dimensionally. However, the magnetic characteristics of such powder composite materials are frequently inadequate, for example with a typical saturation flux density of a metal about 1.5 to about 5 times higher than that of such metal powders bonded in plastic. In this case as well, a shaped body produced in this way has poor mechanical characteristics, for example in the form of mechanical strength.

One known requirement from the known prior art is therefore to optimize the described, potentially mutually opposing, characteristics for the respective application by suitable choice and formation of the material which can be metalized, specifically by matching the magnetic characteristics which are as good as possible with eddy current losses which are as low as possible, with the necessary mechanical characteristics, for example acceptable strength.

The object of the present invention is therefore to provide a magnetizable metallic shaped body and a method for producing such a shaped body, which on the one hand makes it possible to effectively suppress or minimize energetically disadvantageous eddy currents, while on the other hand, as before, making it possible to ensure good magnetic characteristics, in particular a high magnetic (saturation) flux density and low coercivity field strength, in which case a shaped body such as this is also intended to have better mechanical characteristics (for example in comparison to known powder or sintered materials). Furthermore, suitable uses must be provided for a method such as this and shaped bodies produced in this way.

SUMMARY OF THE INVENTION

The object is achieved by the method for producing a shaped body, the shaped body produced by the method and uses of the shaped body. The method for producing a magnetizable metallic shaped body composed of a ferromagnetic raw material which is in the form of powder or particles, comprising the steps of:

(a) First compression a raw material such that adjacent particles are connected to one another by an interlock and/or integral joint in places on their circumferential surface and forming cavities, the first compression is carried out by sintering and/or presintering of a powder, which is compressed by shaking as the ferromagnetic raw material;

(b) production of an electrically insulating surface coating on the circumferential surfaces of the particles in areas outside the connection sections; and (c) second compression of the particles which have been provided with the surface coating, such that the cavities are reduced in size or eliminated.

First of all, the invention is based on the discovery that, when eddy currents are already limited in the micro range (that is to say in the region of the grain size or particle size of the powder ferromagnetic raw material), this results in the resultant shaped body having good magnetic characteristics. In a corresponding manner, by precompression in the form of the step of the first compression of the raw material, the method according to the invention itself makes it possible to produce a (mechanically robust) body by the interlock or integral joint (for example in the form of links) between the adjacent particles, in which case, according to the invention and in the subsequent step of producing the electrical insulating surface coating on the particles, the cavities (according to a development by the introduction of an appropriately reactive gas) are used to provide those surface sections of the particles which are located outside the connection sections (links) to a respectively adjacent particle, with a partial coating which is very thin (relative to the particle size). The subsequent second compression then leads to the cavities being eliminated or greatly reduced in size, thus resulting in a highly compressed particle structure with layer sections of the insulated (surface) coating which—distributed in micro size and in the body—create the intended effect according to the invention of eddy current barriers in the micro range. In other words, the invention makes it possible to produce a magnetizable metallic material as a shaped body, in which (three-dimensionally) electrically non-conductive, thin layer sections (with the layer thickness normally being only in the nanometer range) are present in a distributed form, which act as effective eddy current barriers.

The shaped body produced in this way then not only has the desired high magnetic power density (which is potentially enriched with pure iron material), but the eddy current losses are also significantly reduced by the influence of the layer sections which are distributed three-dimensionally in the body. This then makes it possible, for example, to design electromagnetic units, for example actuators, with improved energy efficiency (conserving resources), with the high flux density achieved with little excitation allowing compact apparatuses, which correspondingly save physical space and result in other advantages.

In addition, a further advantage of the invention is that a shaped body produced according to the invention has excellent mechanical characteristics, particularly with respect to robustness, tensile strength and ultimate strength, in particular in comparison to traditionally known materials and material arrangements for minimizing eddy current losses. It therefore appears to be quite feasible, according to the present invention, to achieve electromagnetic characteristics of a shaped body produced according to the invention which correspond to those of a typical reference material such as FeSi3 but which have significantly better mechanical characteristics than this material. This appears to be plausible against the background that, in an advantageous embodiment of the invention, the insulating surface coating is produced according to the invention after the particles, which are adjacent to one another in the first compression step of the raw material, are connected to one another, with links or the like being formed, correspondingly resulting in the body having good basic strength.

In a manner which is advantageous according to the invention, when implemented in practice, the reactive gas which is introduced into the cavities (in the form of a cohesive pore area) after the first compression step is a gas which oxidizes or nitrides the particle surfaces outside the connection sections (links), in which case a gas such as this may also be a gas which contains carbon, nitrogen, oxygen, sulfur and/or boron. It is also within the scope of the invention for a gas such as this not to be supplied separately but to use as the reactive gas that gas which is (residually) already present in the raw material, which is in the form of powder, and/or is created or formed during the first compression process, in which case the step of production of the electrically insulating surface coating is carried out with the first compression.

While, furthermore, in the course of preferred embodiments of the invention, pressing (preferably isostatic and/or cold hydrostatic) with the first pressing pressure of more than 300 bar, typically of 1000 bar or more, is carried out in the first compression step, the second compression after the production of the insulating surface coating, is a process which is typically carried out by hot hydrostatic pressing at a significantly higher pressing pressure of up to about 4000 bar. This pressing pressure at a typical temperature of more than 1000° C. leads to flowing of the material, with the result that (with a significant reduction in the pores, or even disappearing completely) the layer sections of the insulating surface coating (which, with a thickness in the typical nanometer range, each have a longitudinal extent corresponding approximately to the raw material grain sizes) are in a distributed form in the resultant shaped body, allowing the intended eddy-current-restricting effect at the micro level.

According to a development, the invention covers the metallic shaped body being subjected after the second compression to a mechanical forming step and/or to subsequent machining, in order in this way to shape the shaped body for the intended purpose. Furthermore, a forming step such as rolling, drawing or the like may be suitable for ensuring that isotropy of the layer sections which are distributed in the shaped body can be changed deliberately.

While, on the one hand, the invention covers uncoated ferromagnetic particles, for example pure iron particles, being used as the ferromagnetic raw material, an alternative embodiment of the invention provides for particles in the form of powder to be supplied to the inventive process, which are themselves in the form of coated particles, for example iron particles, with (a different) metallic coating or a semiconductor coating (for example as a result of previous plasma coating). On the one hand, this then makes it possible to influence the mechanical connection behavior (for example the quality of the sintered links) after the first compression step, while on the other hand such prior coating of the particles also makes it possible to produce advantageous insulating surfaces by deliberate formation of the reactive gas to be introduced into the pore area (for example an aluminum-oxide surface coating by oxidation of an iron particle previously coated with aluminum, with the aid of the coating step).

The shaped body produced in the described manner according to the invention can in principle be used for a large number of magnetic applications, in which case the advantages described above with respect to efficiency, magnetic behavior, mechanical compactness and robustness can each be suitably instrumentalized—for example with the potential field of use of the present invention extending from magnetic actuators or drive apparatuses (such as electromagnetic actuating elements and electric motors) through use in transformers and other fields of power electronics, to electromagnetic bearings and radio-frequency applications.

BRIEF DESCRIPTION OF THE DRAWINGS

Further advantages, features and details of the invention result from the preferred exemplary embodiments in the following description and from the drawings, in which.

DETAILED DESCRIPTION

According to a first process step, iron raw material with a typical average grain size in the range from about 10 μm to 500 μm and in the form of powder is provided; the reference sign 10 relating to the process step S1 illustrates the presence of such powder particles in the uncoated state. Typical, commercially available powder materials, with respect to a comparable small grain size, are, for example, pure iron powder (Fe2) with a grain size of <30 μm, D50 (medium grain size) 9 μm to 11 μm manufactured by ThyssenKrupp Metallurgie, and in the case of a larger grain size, by way of example the product Ampersint (atomized iron-based powder from HC Starck GmbH); in this case, at least 99.5% by weight of the grain size of iron is less than 350 μm. Alternative iron-based powders from this manufacturer are FeSi3 or FeSi6, with a corresponding grain size.

Process step S2, as an optional process step, provides the capability for the powder particles of the raw material to be provided with metallization or a semiconductor coating, for example by means of plasma coating or the like, before subsequent first compression (step S3). This layer, which can optionally be applied in step S2, is thin in comparison to the relevant particle diameter, and is typically in the range between 5 and 50 nm.

Figure 1:
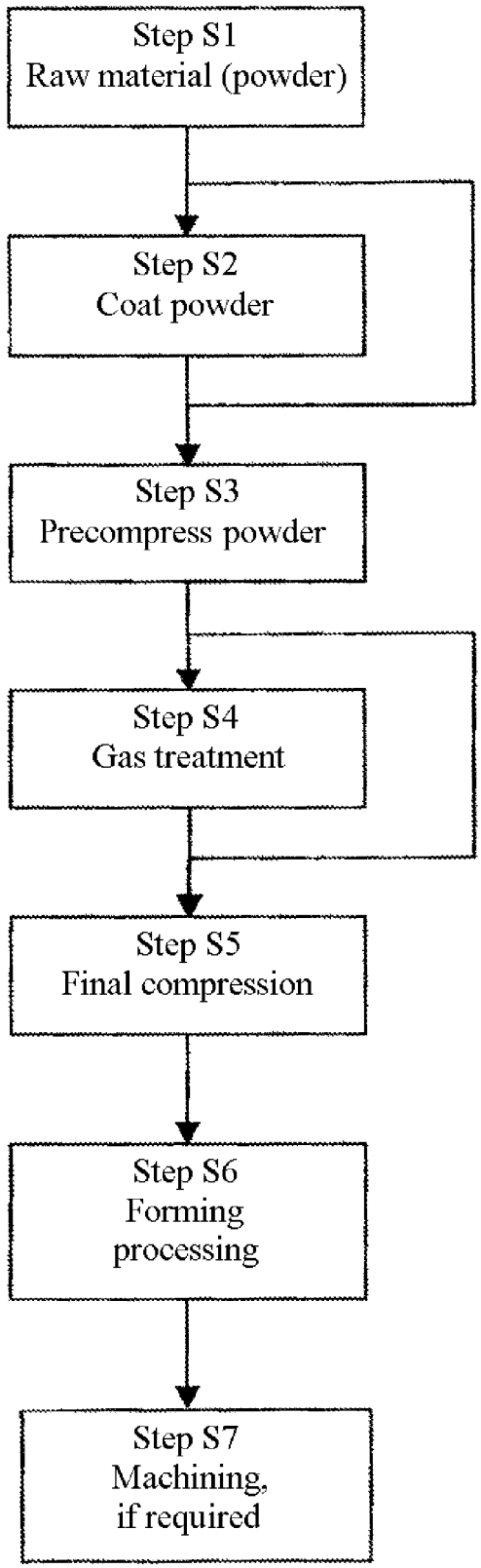
FIG. 1 shows a flowchart with process steps S1 to S7 for carrying out the method according to the invention, according to a first embodiment.
Figure 2:
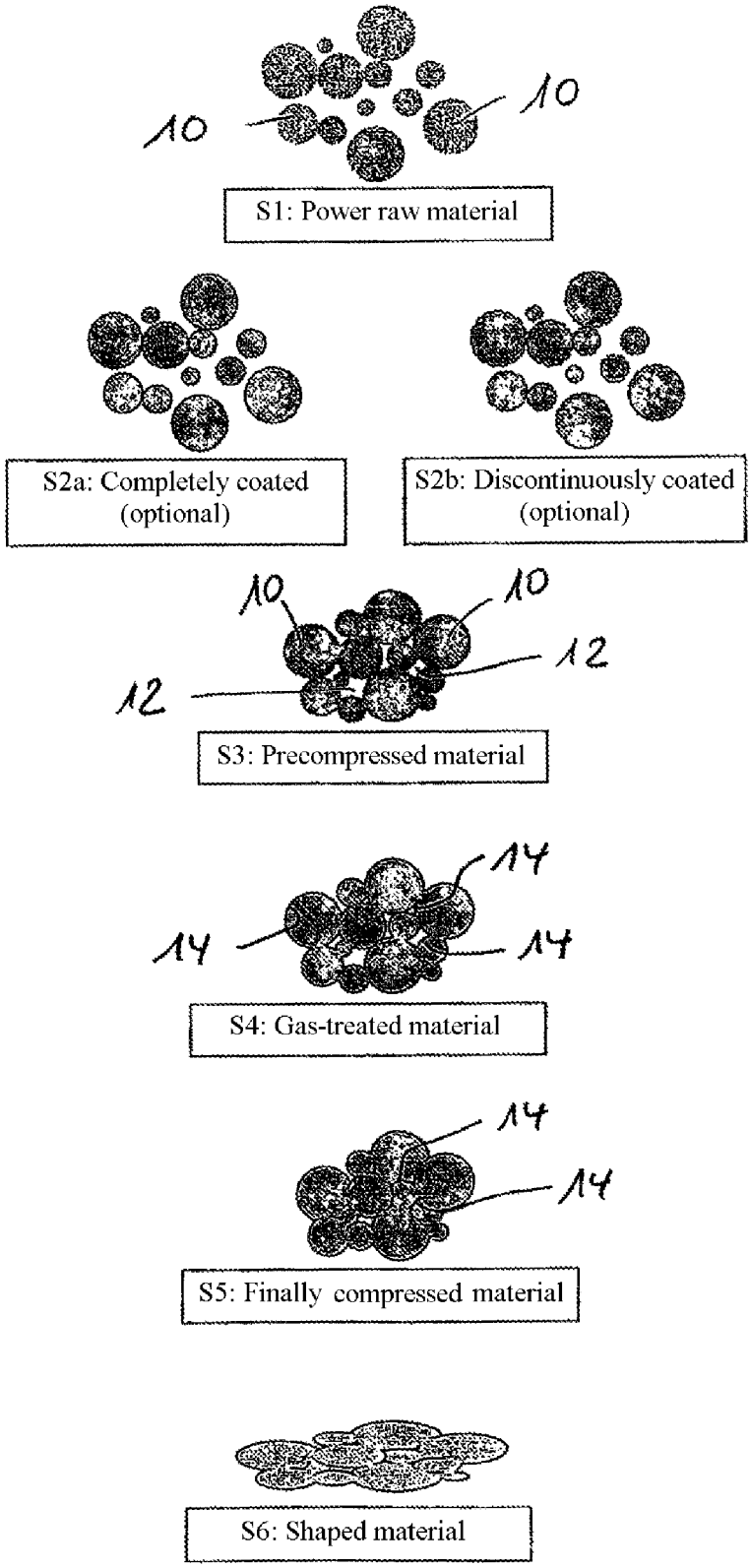
FIG. 2 shows a view with a plurality of schematic illustrations, which illustrate the forming of the shaped body, and of the particles of the raw material, which is changed according to the process, along the steps S1 to S6 in FIG. 1.

First precompression of the (coated or uncoated) raw material takes place in the subsequent process step S3, which is typically cold hydrostatic pressing with a pressing pressure of about 1000 bar. This results in the image of a precompressed body as illustrated in FIG. 2 (for uncoated raw material), in which the particles 10 adhere mechanically firmly to one another by means of sintered links.

In the subsequent process step S4, an oxidizing gas, in the present case oxygen, is introduced into the shaped body at a pressure of 0.01 bar and at a temperature of 350° C., as a result of which this gas enters the cavities 14 and correspondingly provides the particles 10 with an (electrically insulating) thin oxide layer 14 in all those circumferential areas which are not connection sections to a respectively adjacent particle. A typical resultant coating thickness on the particles after the gas treatment step S4 (duration in the described example 30 minutes) is about 10 nanometers. This layer thickness can be influenced, for example, by varying the pressure, temperature or time of influence.

A subsequent second compression step S5 (so-called consolidation) is typically carried out as compression at high temperature, in particular by means of hot hydrostatic pressing; typical process parameters are a pressing pressure of up to about 4000 bar at a temperature of 1200° C. This leads to—cf. the illustration in FIG. 2 relating to S5—the pores (intermediate spaces) 12 disappearing or being considerably reduced in size, as a result of which essentially only oxide layer sections 14 remain distributed in the material in the finally compressed material at the end of the process step S5, corresponding to the original coating sections on the circumferential surfaces of the particles and compressed pores. These very flat oxide layer sections therefore have typical lengths in the range from about 10 to 150% of the original grain size of the particles and are very thin in comparison to this dimension, specifically once again in the nanometer range (normally 5 to about 30 nanometers).

As a result of their distribution in the finally compressed material, these oxide layer sections act as eddy current obstructions, which are effective according to the invention, in the micro range, at the same time allowing the finally compressed material produced in this way (which in the illustrated exemplary embodiment is also shaped to an intended final shape by rolling in a subsequent step S6 and is also subjected to subsequent machining in the subsequent step S7) to have very good magnetic characteristics in terms of a high saturation flux density and low coercivity field strength, with a good response being achieved even measured against a known machining steel (for example 1.0715), which is typically used for direct-current applications. A material produced in this way is also considerably superior to a typical reference material for alternating-current applications (for example FeSi3).

The invention claimed is:

1. A method for producing a magnetizable metallic shaped body composed of a ferromagnetic raw material which is in the form of powder or particles, comprising the steps of:

(a) first compression of a raw material such that adjacent particles are connected to one another by an interlock and/or integral joint in places on their circumferential surface and forming cavities, the first compression is carried out by sintering and/or presintering of a powder, which is compressed by shaking, as the ferromagnetic raw material;

(b) production of an electrically insulating surface coating on the circumferential surfaces of the particles in areas outside the connection sections;

(c) second compression of the particles which have been provided with the surface coating, such that the cavities are reduced in size or eliminated; and (d) forming the shaped body.

2. The method as claimed in claim 1, wherein the electrically insulating surface coating is produced by introduction of a gas into the cavities, which gas produces the surface coating by reaction with the circumferential surfaces.

3. The method as claimed in claim 1, wherein the electrically insulating surface coating is produced by a gas which is already present in or with the raw material during the first compression step of the raw material, or is created during the first compression.

4. The method as claimed in claim 2 or 3, wherein the gas comprises carbon, nitrogen, oxygen, sulfur and/or boron and results in a chemical reaction such that the circumferential surface is provided with the electrically insulating surface coating outside the connection sections.

5. The method as claimed in claim 1, wherein the electrically insulating surface coating has a layer thickness in the range between 2 nm and 50 nm.

6. The method as claimed in claim 1, wherein the first compression presses the raw material at a first pressing pressure of more than 50 bar.

7. The method as claimed in claim 1, wherein the first compression presses the raw material at a first pressing pressure of more than 300 bar.

8. The method as claimed in claim 1, wherein the first compression presses the raw material at a first pressing pressure of more than 1000 bar.

9. The method as claimed in claim 1, wherein the sintering or presintering is carried out by heat treatment and without pressing.

10. The method as claimed in claim 1, wherein the second compression involves pressing of the particles which have been compressed by the first compression and have been provided with the electrically insulating surface coating, and a second pressing pressure which is higher than the first pressing pressure, in particular higher by at least 10%.

11. The method as claimed in claim 10, wherein the second compression is carried out by hot hydrostatic or isostatic pressing.

12. The method as claimed in claim 11, wherein the hot hydrostatic or isostatic pressing during the second compression is carried out at a temperature and a pressing pressure which result in the particles and/or the layer sections of the insulating surface coating flowing.

13. The method as claimed in claim 1, wherein the step of forming of the shaped body after the second compression is by one of rolling and deep-drawing.

14. The method as claimed in claim 1, wherein the forming results in a change to and/or elimination of isotropy of layer sections of the insulating surface coating, which layer sections are present in the shaped body after the second compression.

15. The method as claimed in claim 1, wherein the ferromagnetic raw material has uncoated iron particles.

16. The method as claimed in claim 15, wherein the ferromagnetic raw material has iron particles which are coated with a metal material or semi-conductor material.

17. The method as claimed in claim 16, wherein the coating on the iron particles in the raw material has a thickness of <1000 nm.

18. The method as claimed in claim 16, wherein the coating on the iron particles in the raw material has a thickness of <100 nm.

19. The method as claimed in claim 16, wherein the coating on the iron particles in the raw material has a thickness of <10 nm.

20. The method as claimed in claim 15, wherein a mean grain size of the particles of the ferromagnetic raw material which are present as powder is in the range between 5 μm and 1000 μm.

21. The method as claimed in claim 1, wherein the metallic shaped body is used to produce magnetizable components of electromagnetic actuator and/or drive apparatuses, in particular of an electromagnetic actuating element or of an electric motor, of a magnetic bearing or of a transformer.

22. The method as claimed in claim 1, wherein the shaped body is used to produce a radio-frequency component or a radio-frequency assembly.

* * * * *